United States Patent [19]

LeRoy

[11] 4,186,683

[45] Feb. 5, 1980

[54] BOOK MARK-PAGE LINE-READER

[76] Inventor: Edward W. LeRoy, 45-25 Kennedy Blvd., North Bergen, N.J. 07047

[21] Appl. No.: 956,883

[22] Filed: Nov. 1, 1978

[51] Int. Cl.[2] ..... B42D 9/00

[52] U.S. Cl. ..... 116/235; 116/240; 281/42

[58] Field of Search ..... 116/234, 235, 240; 281/42

[56] References Cited

U.S. PATENT DOCUMENTS

| | | | |
|---|---|---|---|
| 598,666 | 2/1898 | Thomas | 281/42 X |
| 1,478,655 | 12/1923 | Hughes | 116/234 |
| 1,658,499 | 2/1928 | Stevens | 40/352 |
| 1,919,971 | 7/1933 | Wulkop | 116/234 |
| 2,095,141 | 10/1937 | Levin | 116/234 |
| 2,585,421 | 2/1952 | Dumais | 116/235 |
| 2,586,890 | 2/1952 | Voss | 116/240 X |
| 3,324,823 | 6/1967 | Peters | 281/42 X |

OTHER PUBLICATIONS

Publication: "Labels" in Chemistry Apparatus, The Welch Scientific Co. pp. 543–544.

*Primary Examiner*—Daniel M. Yasich

[57] ABSTRACT

A sheet of opaque plastic the shape and dimensions of a book page, with an arrow cutout shaped in the sheet extending beyond the page on the right edge as viewed when a book is opened, to indicate as to whether it is the upper or lower part of either page where the user's reading was interrupted. Also, a self-adhesive movable arrow label positioned on the right or left edge of the opaque plastic sheet to indicate the exact line on either page where reading was interrupted. This enables a reader to locate the exact line where reading was interrupted without looking over approximately eighty lines on two pages by glancing at both arrows. In addition, by viewing only five lines through an elongated rectangular cutout, eye strain is reduced.

2 Claims, 4 Drawing Figures

BOOK MARK-PAGE LINE-READER

The object therefore is to provide a book mark-page line-tired eyes reader of simple structure, which is inexpensive in manufacture, used with facility and convenience and functions efficiently, effectively and reliably, to indicate to a reader its three practical features.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The book mark-page line-tired eyes reader comprises a sheet of opaque plastic 1 of a suitable type. It has the shape and dimensions of a page of a book so that it is of substantially rectangular shape having a pair of spaced parallel side edges 2 and 3 (FIGS. 1 to 4) and spaced parallel top and bottom edges 4 and 5 joining said side edges and extending substantially perpendicularly thereto, as shown in FIGS. 1 to 4.

Figure 1:
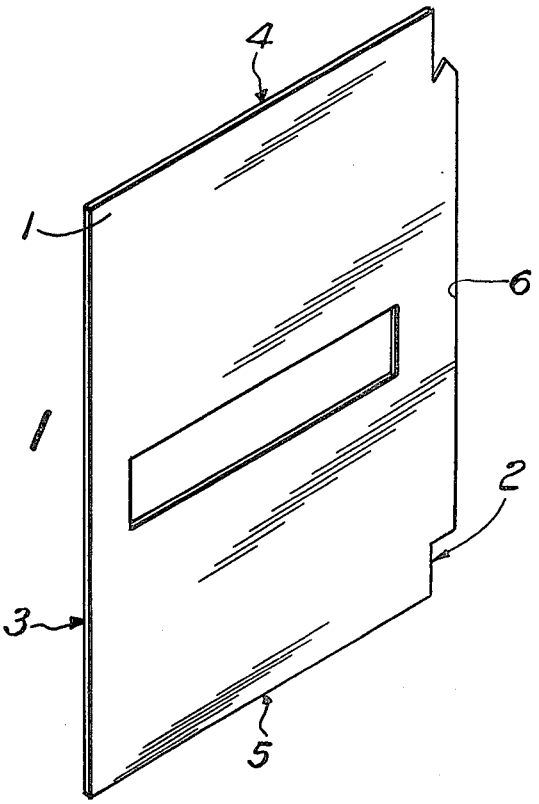
FIG. 1 is a perspective view of an embodiment of the book mark-page line-tired eyes reader.
Figure 2:
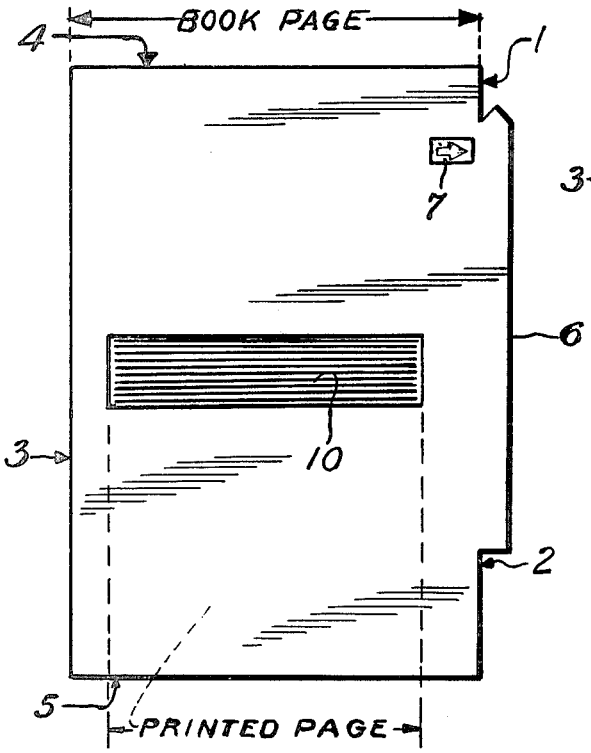
FIG. 2 is a plan view of the embodiment of FIG. 1 positioned over a right-hand page of a book.
Figure 3:
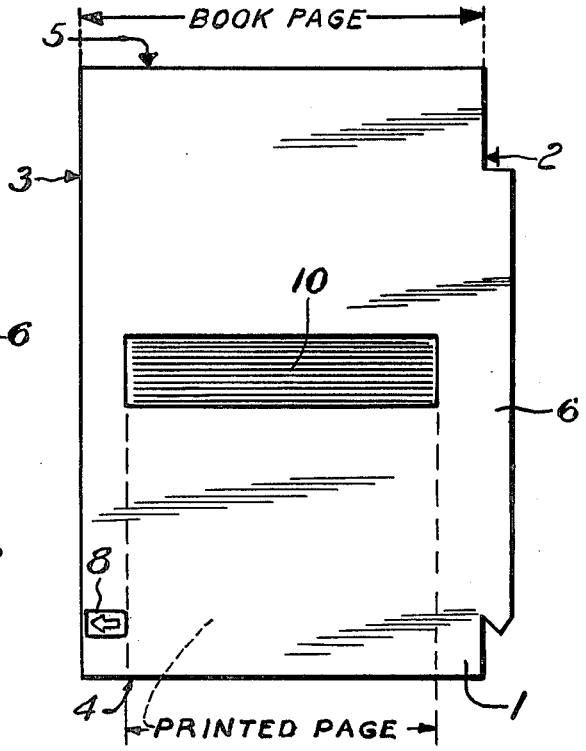
FIG. 3 is a plan view of the embodiment of FIG. 1 showing book mark arrow reversed, positioned over a left-hand page of a book.
Figure 4:
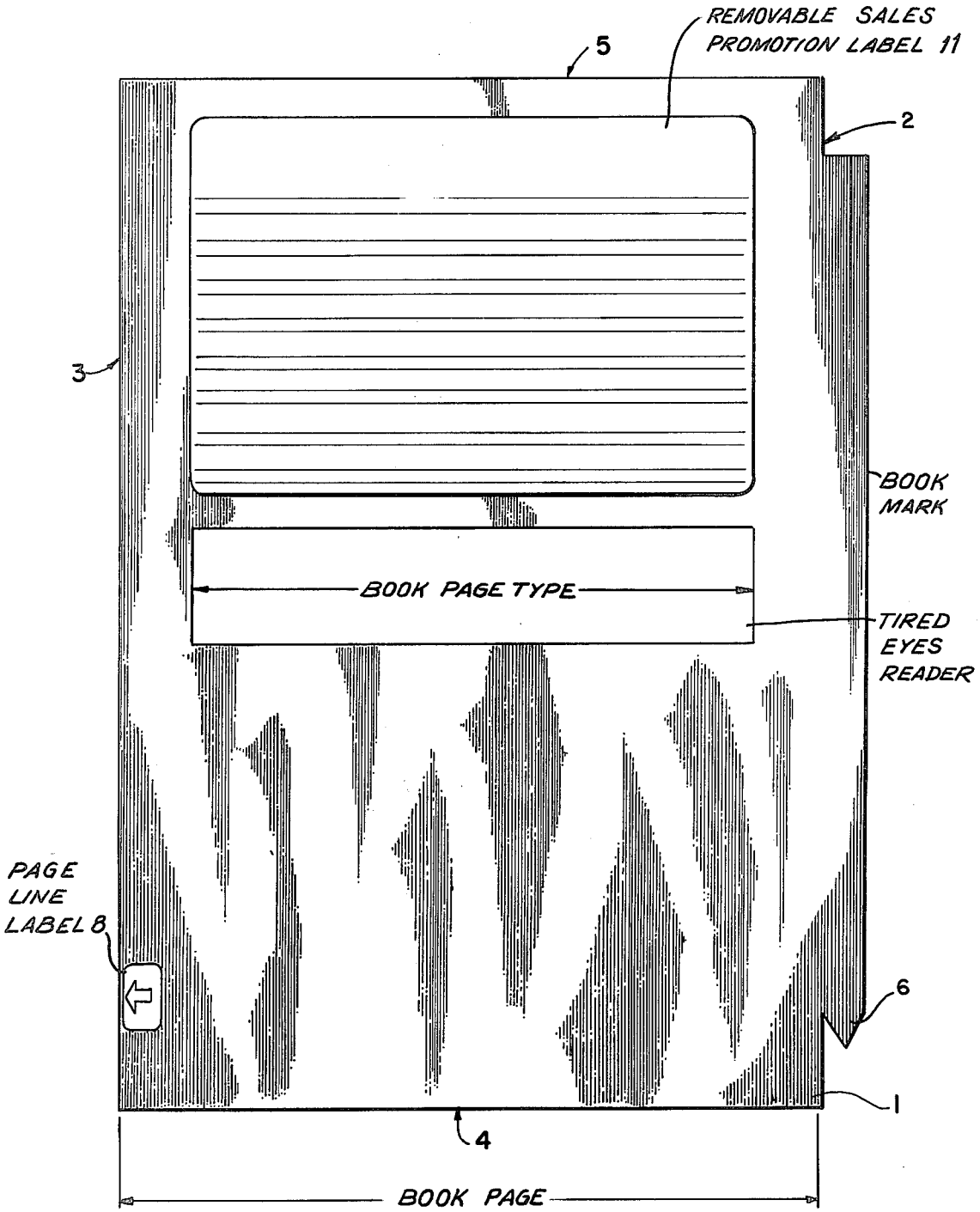
FIG. 4 is the view of FIG. 3, on an enlarged scale.

In accordance with the invention, the book mark-page line-tired eyes reader comprises an arrow 6 shaped in the sheet 1 at the side edge 2 thereof and extending beyond said side edge, as shown in FIGS. 1 to 4. The arrow 6 points toward the top edge 4, as shown in FIGS. 1 and 2, when it indicates the upper part of either left or right-hand page where reading was interrupted. The arrow 6 points to the bottom edge 4 of the sheet 1 when it indicates the lower part of either left or right-hand page where reading was interrupted as shown in FIGS. 3 and 4, the sheet is reversed. Thus, the arrow 6 indicates the half of either page where reading was interrupted. When used in the position shown in FIG. 2, the book mark arrow 6 indicates that the reader stopped reading in the upper half of either the left or right-hand page of the book. When used in the position shown in FIGS. 3 and 4, the arrow 6 indicates that the reader stopped reading on the lower half of either the left or right-hand page of the book.

An arrow 7 and an arrow 8 are provided on self-adhesive labels and affixed on sheet 1 at either edge 2 or 3 by the reader, to indicate the exact line where reading stopped. Thus, as shown in FIG. 2, the arrow 7 is placed by the reader at edge 2 of sheet 1, to indicate that reading stopped at the line indicated, in the upper half of the right-hand page of the book. As shown in FIGS. 3 and 4, the arrow 8 is affixed by the reader at edge 3 of sheet 1 to indicate the line of the lower half of the left-hand page of the book where reading stopped.

The tired eyes reader consists of a substantially elongated rectangular cutout formed through the sheet 1 and positioned to encompass a predetermined number of printed lines of the page being read by the reader. The cutout has sufficient dimensions to encompass such lines and thus accentuates or clarifies the particular lines encompassed so that it is especially soothing for tired eyes by permitting only a few lines to be seen. As shown in FIGS. 2 and 3 a few lines 10 of the page over which the sheet 1 is placed are accentuated by the cutout.

In the modification of FIG. 4, a self-adhesive removable label 11 is affixed to sheet 1 and contains sales promotional material.

Having described a preferred embodiment of my invention, it is understood that various changes can be made without departing from the spirit of my invention, and, I desire to cover by the appended claims all such modifications as fall within the true spirit and scope of my invention.

I claim:

1. A book mark-page line-tired eyes reader, comprising a sheet of opaque plastic having the shape and dimensions of a book page; and comprising an arrow cutout shaped in a middle portion of the right edge of said sheet as viewed when a book is opened thereof, pointing to the top or bottom edge to indicate on which half of either page the user interrupted his reading, and a self-adhesive removable arrow label placed on one of the right or left edges on the sheet pointing to the exact line on either page to indicate where the reader interrupted his reading; and means formed on the sheet so as visibly encompass at least one printed line.

2. A book mark-page line-tired eyes reader as claimed in claim 1, wherein said means formed in the sheet comprises an elongated rectangular cutout through the sheet, positioned to encompass five printed lines so that only they are visible.

* * * * *